US007121787B2

(12) United States Patent
Jacks et al.

(10) Patent No.: US 7,121,787 B2
(45) Date of Patent: Oct. 17, 2006

(54) TURBINE NOZZLE TRAILING EDGE COOLING CONFIGURATION

(75) Inventors: Curtis John Jacks, Greenville, SC (US); Robert Walter Coign, Piedmont, SC (US); Randall Douglas Gill, Greenville, SC (US)

(73) Assignee: General Electric Company, Schenectady, NY (US)

( * ) Notice: Subject to any disclaimer, the term of this patent is extended or adjusted under 35 U.S.C. 154(b) by 129 days.

(21) Appl. No.: 10/834,055

(22) Filed: Apr. 29, 2004

(65) Prior Publication Data

US 2005/0244264 A1 Nov. 3, 2005

(51) Int. Cl.
*F01D 9/02* (2006.01)
*F01D 5/18* (2006.01)

(52) U.S. Cl. ..... 415/115; 416/97 R

(58) Field of Classification Search ..... 415/115, 415/191; 416/97 R
See application file for complete search history.

(56) References Cited

U.S. PATENT DOCUMENTS 5,288,207 A * 2/1994 Linask ..... 416/97 R
6,099,251 A 8/2000 LaFleur
6,607,355 B1 8/2003 Cunha et al.

* cited by examiner

*Primary Examiner*—Richard A. Edgar
(74) *Attorney, Agent, or Firm*—Nixon & Vanderhye P.C.

(57) ABSTRACT

The trailing edge region of a nozzle airfoil is provided with a cooling configuration wherein post-impingement cooling air flows between radially spaced ribs defining convective cooling channels into a generally radially extending plenum. Cooling air in the plenum is split between film cooling holes for film cooling the pressure side of the trailing edge region and for flow about downstream pins for pin cooling the downstream regions of the opposite sides of the airfoil. The cooling air exiting the pins is directed through convective channels defined by a second set of radially spaced ribs and through exit apertures on the pressure side of the trailing edge.

19 Claims, 3 Drawing Sheets

TURBINE NOZZLE TRAILING EDGE COOLING CONFIGURATION

BACKGROUND OF THE INVENTION

The present invention relates to a trailing edge air cooling configuration for a turbine nozzle, and particularly relates to a hybrid convective channel and pin cooling configuration for the trailing edge portion of a gas turbine nozzle vane.

Gas turbine nozzle cooling is typically achieved by locating impingement inserts within the airfoil cavities, e.g., two or more cavities of the first stage nozzle of a gas turbine. The pressure and suction sides of the vane are thus impingement cooled. The post-impingement cooling air is then either discharged through film holes along the airfoil surface to provide an insulating barrier of cooler air between the hot gas stream and the airfoil or sent to an additional circuit to convectively cool the airfoil trailing edge. The additional trailing edge circuit is required due to geometric limitations of the vane, i.e., there is insufficient space within the airfoil cavity to extend the aft impingement insert to the trailing edge. Furthermore, three-dimensional advanced airfoil nozzle vanes have a high degree of bowing and twist. This lengthens the trailing edge region where impingement cooling using inserts is not mechanically practical.

Various trailing edge air cooling circuits have been proposed and utilized in the past. Certain circuits use pins extending between the opposite sides of the airfoil for receiving the post-impingement cooling flow for cooling the trailing edge portion. Pin cooling, however, is associated with a substantial pressure drop and is practical over very short distances. Turbulative convective channel designs have also been employed, resulting in a lower pressure drop. However, those designs often achieve insufficient cooling efficiency to meet cooling performance requirements for the nozzle vane. There are also examples of pin cooling and convective channel cooling circuits coexisting in the same design. However, there has developed a need for even further cooling efficiencies, particularly for nozzle vanes having a high degree of bowing and twist in enhanced three-dimensional aerodynamic designs which will meet the cooling requirements for these advanced aerodynamic designs.

BRIEF DESCRIPTION OF THE INVENTION

In accordance with a preferred aspect of the present invention, post-impingement cooling air is directed to a trailing edge portion cooling circuit wherein the air first passes through turbulated convective cooling channels and into a plenum. Film cooling holes are arranged on the pressure side of the vane for receiving post-impingement cooling air from the plenum for film cooling. The convective channels upstream of the plenum provide a pressure drop sufficiently low to maintain the required pressure in the plenum to drive the flow through the film cooling holes. The balance of the post-impingement cooling air then passes about rows of pins which then cools the region of the trailing edge portion with the relatively higher external heat load as compared with the heat load adjacent the upstream convective cooling channels. The greater pressure drop associated with the post-impingement air flowing about the cooling pins is tolerated because the remaining coolant is then discharged through trailing edge apertures on the pressure side where the dump pressures are lower. Consequently, an optimal cooling arrangement is provided to satisfy unique cooling and performance requirements of the trailing edge portion of a nozzle vane having a high degree of bowing and twist in an advanced aerodynamic design.

In a preferred embodiment according to the present invention, there is provided an air-cooled nozzle for disposition in the hot gas path of a turbine comprising inner and outer platforms with an airfoil extending therebetween, the airfoil having opposite pressure and suction sides and an air-cooled trailing edge region having a trailing edge; a plurality of ribs in the trailing edge region extending between the opposite sides and spaced one from the other in a generally radial direction between the platforms defining a plurality of generally axially extending radially spaced flow channels for directing cooling air generally axially toward the trailing edge; a plurality of pins extending between the opposite sides of the airfoil at locations spaced axially downstream from the ribs and spaced radially from one another for impingement by the cooling air exiting the channels; and exit apertures adjacent the trailing edge spaced radially from one another opening through the pressure side for flowing air received from about the pins to cool the trailing edge and for discharge into the hot gas path of the turbine.

In a further preferred embodiment according to the present invention, there is provided air-cooled nozzle for disposition in the hot gas path of a turbine comprising inner and outer platforms with an airfoil extending therebetween, the airfoil having opposite pressure and suction sides and an air-cooled trailing edge region having a trailing edge; a plurality of ribs in the trailing edge region extending between the opposite sides and spaced one from the other in a generally radial direction between the platforms defining a plurality of generally axially extending radially spaced flow channels for directing cooling air generally axially toward said trailing edge; a plurality of pins extending between the opposite sides of the airfoil at locations spaced axially downstream from the ribs and spaced radially from one another for impingement by the cooling air exiting the channels; and a plenum located generally axially between the ribs and the pins, and a plurality of film cooling holes in the pressure side of the airfoil in communication with the plenum, whereby cooling air is enabled for flow through the holes and internally within the trailing edge region about the pins.

DETAILED DESCRIPTION OF THE INVENTION

Figure 1:
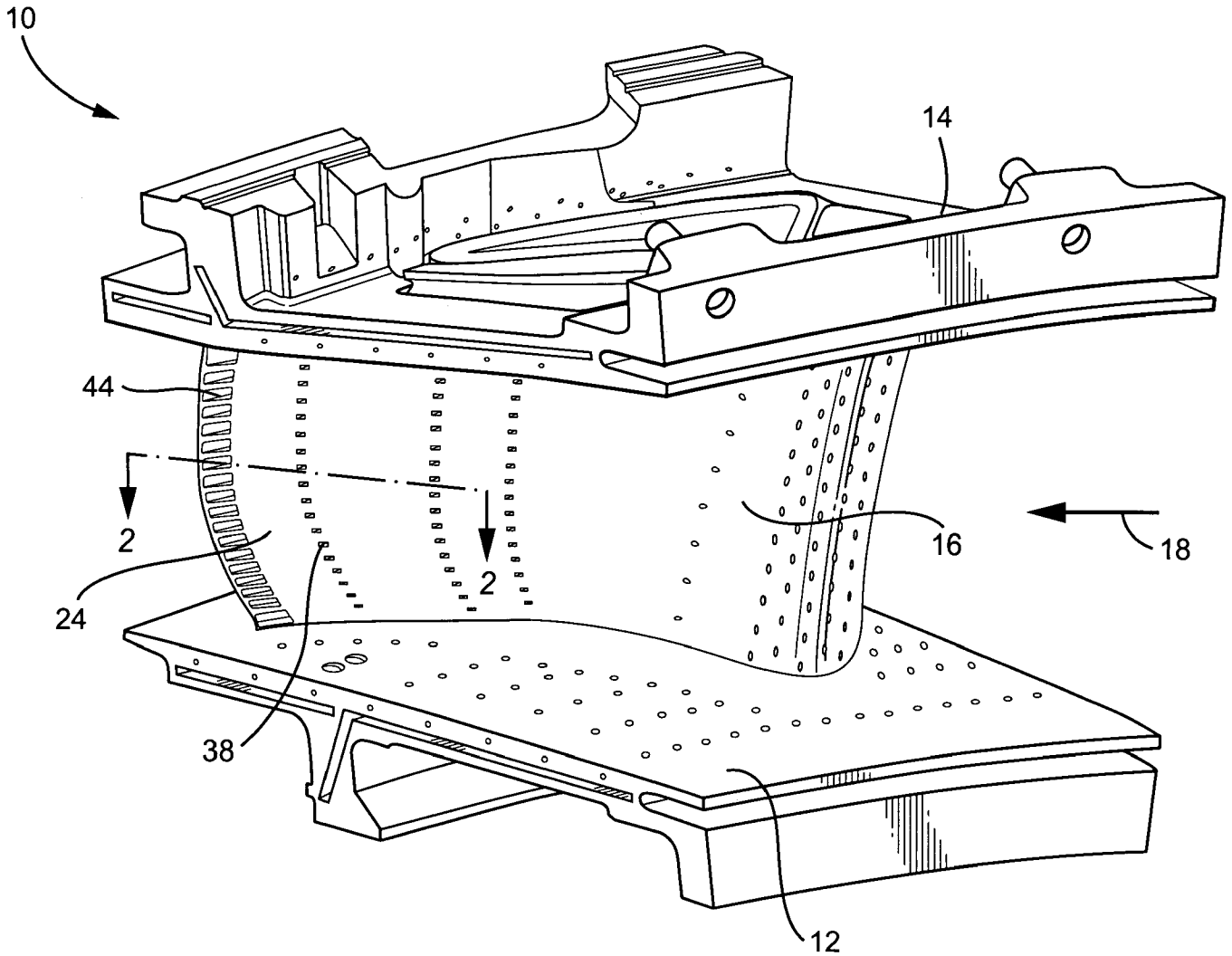
FIG. 1 is a perspective view of a nozzle segment for a gas turbine illustrating the inner and outer platforms and an airfoil or vane extending therebetween with a trailing edge cooling configuration according to a preferred aspect of the present invention.

Referring now to the drawings, particularly to FIG. 1, there is illustrated a nozzle segment generally designated 10 including an inner platform 12, an outer platform 14 and an airfoil or vane 16 extending between the inner and outer platforms. It will be appreciated that the nozzle segment 10 is one of a plurality of nozzle segments which are arranged in a circumferential array thereof about a turbine axis and which form a fixed or stationary part of a stage of a turbine, for example, the first stage of a turbine. Also, while a single airfoil or vane 16 is illustrated between the inner and outer platforms 12 and 14, respectively, each segment may contain two or more airfoils or vanes extending between the platforms. In the illustrated segment, the cooling holes are provided in various parts of the inner and outer platforms as well as the airfoil to cool the various parts of the nozzle segment, it being further appreciated that the inner and outer platforms and the airfoil or vane in the circumferential array thereof define a portion of the hot gas path generally indicated by the arrow 18 through the turbine. While not forming part of the present invention, it will also be appreciated that the airfoil 16 includes one or more inserts within the nozzle airfoil for receiving cooling air, for example, compressor discharge air for impingement cooling of the side walls of the airfoil as illustrated by the arrows 22 in FIG. 2. The post-impingement cooling air is directed into a trailing edge region 24 of the airfoil 16 which contains a trailing edge cooling configuration according to an aspect of the present invention. Region 24 terminates at the trailing edge 25.

Figure 2:
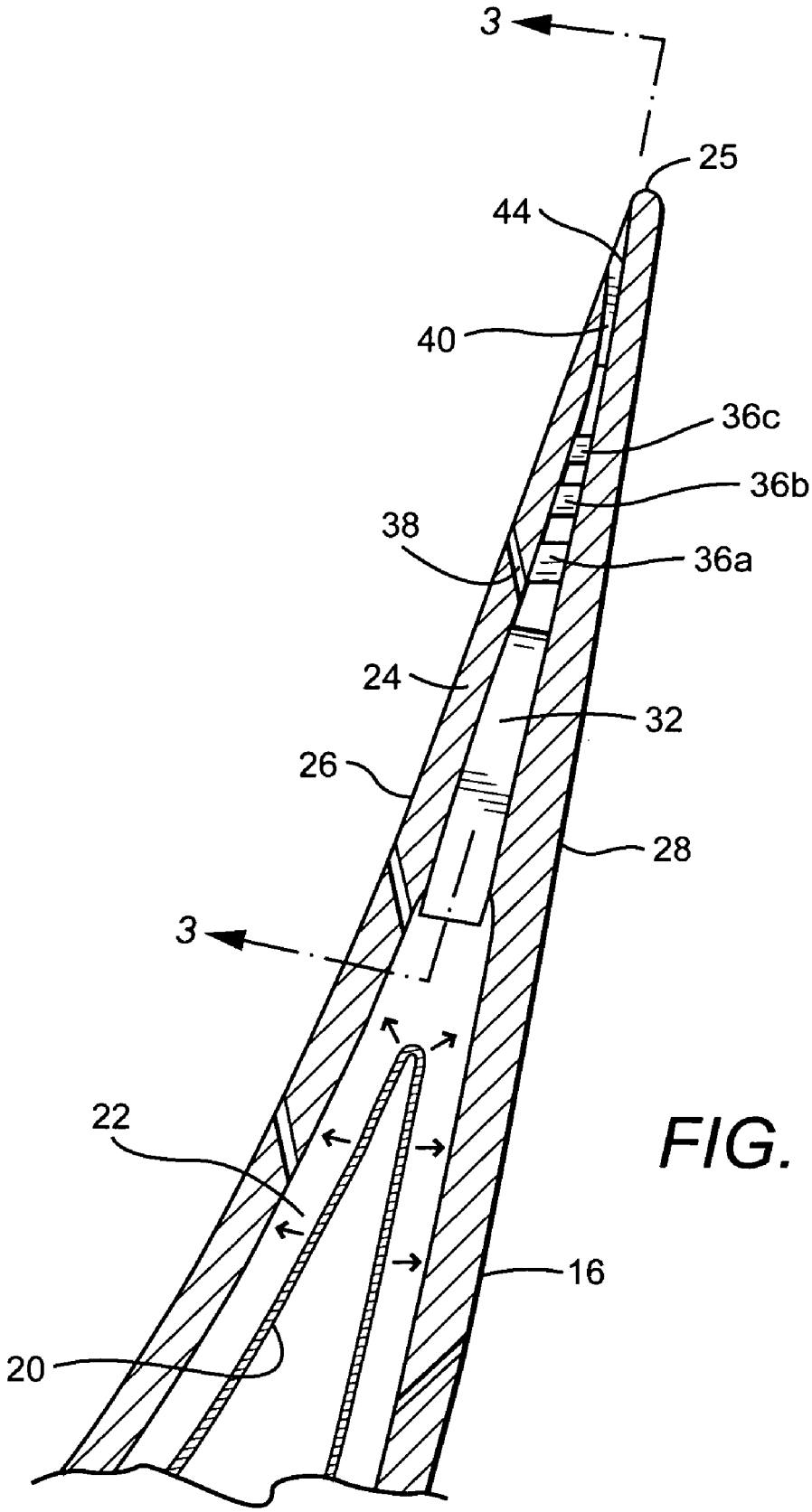
FIG. 2 is an enlarged cross-sectional view through a trailing edge portion of the nozzle airfoil taken generally about on lines 2—2 in FIG. 1.

The vane 16 has pressure and suction sides 26 and 28, respectively, as best illustrated in FIG. 2. The airfoil, as illustrated in FIG. 1, is an advanced three-dimensional aerodynamic design having substantial bow and twist which, in the trailing edge region 24, extends in the axial direction sufficiently that the impingement air cooling inserts cannot be utilized to cool the trailing edge portion. Consequently, the present trailing edge configuration for the trailing edge region 24 is provided for cooling the trailing edge region beyond the extent of the impingement air cooling provided by the inserts 20.

Figure 3:
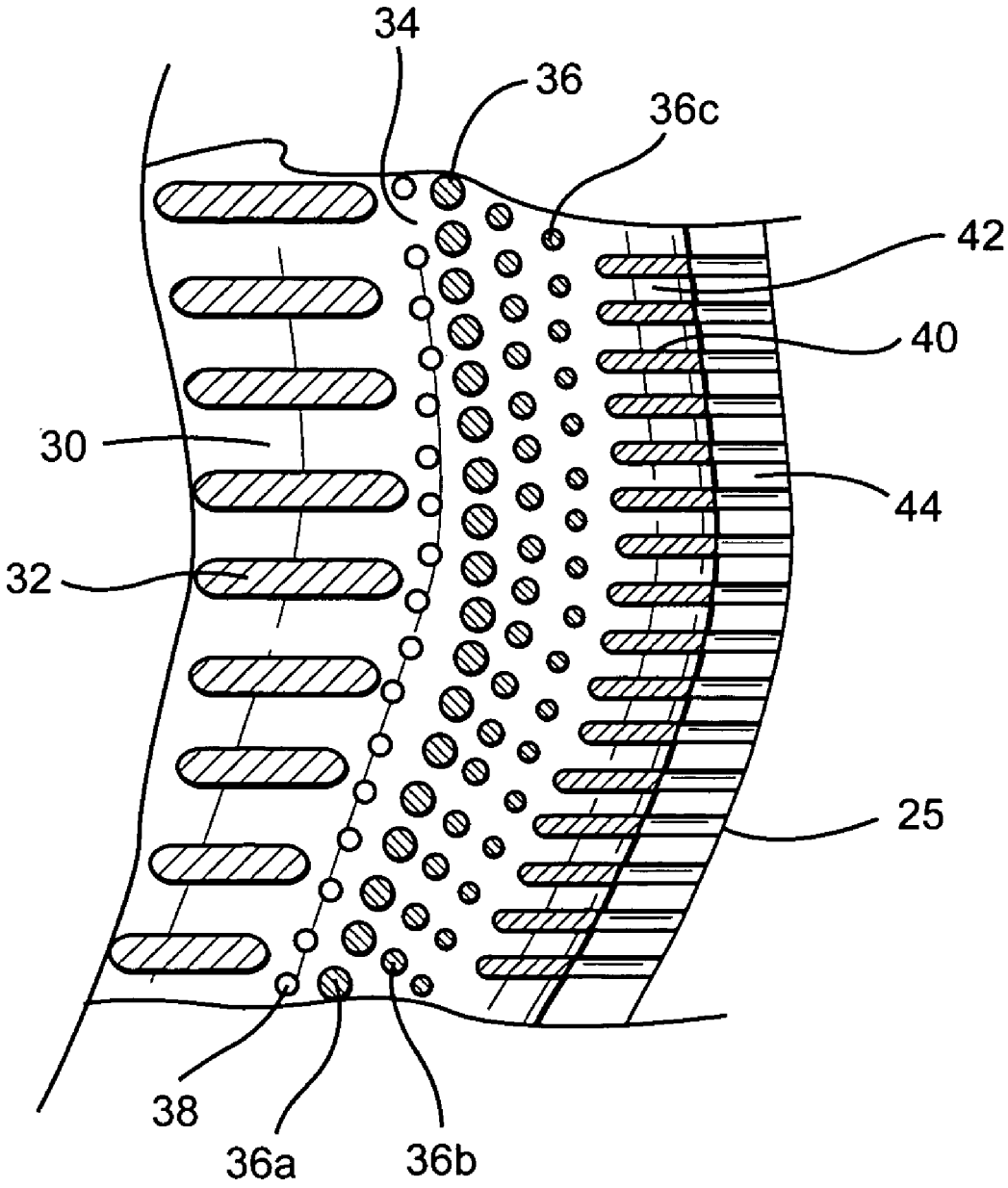
FIG. 3 is a generally circumferential fragmentary cross-sectional view through the trailing edge portion of the nozzle airfoil taken about on line 3—3 in FIG. 2.

Referring to FIG. 3, post-impingement cooling air flowing into the trailing edge region 24 first passes through turbulated convective channels 30 defined between generally axially extending radially spaced ribs 32. The post-impingement airflow 30 convectively cools opposite sides of the vane as it passes between the ribs 32. The airflow exiting the channels 30 passes into a generally radially extending plenum 34. Downstream of the plenum 34 are a plurality of pins 36 extending between opposite sides of the airfoil 16. The pins 36 are spaced generally radially one from the other and are provided in three generally axially spaced radially extending rows thereof. The pins 36 are generally cylindrical in cross-sectional configuration but may have other cross-sectional shapes. As illustrated, the first row of pins 36*a* are located to intercept the flow channels 30 and thus are impinged by the flow stream exiting the channels 30. The second row of pins 36*b* are spaced axially downstream from the first row of pins 36*a* and positioned to intercept the flow of cooling air exiting from between the pins 36*a*. Finally, a third row of pins 36*c* are positioned axially downstream of the first and second rows and are positioned to intercept the cooling air flow exiting from between the pins of the second row 36*b*. Additionally, it will be seen in FIG. 3 that the pins 36 have decreasing diameters in a downstream direction. That is, the pins 36*a* of the first row have a diameter greater than the diameters of the pins 36*b* of the second row, and the diameter of the pins 36*b* of the second row is greater than the diameter of the pins 36*c* of the third row.

Also in communication with the plenum 34 is a generally radially spaced row of film cooling holes 38 which open through the pressure side only of the airfoil 16. Thus, the air from the plenum 34 in part flows through the film cooling holes 38 to film cool the trailing edge region on the pressure side of the vane while the remaining portion of the cooling air in plenum 34 flows about the rows of pins 36 for cooling augmentation along the pressure and suction sides of the trailing edge region. Downstream of the pins 36 are a plurality of generally radially spaced ribs 40 defining therebetween generally axially extending flow paths 42 for receiving the cooling air exiting from the rows of pins 36. Consequently, the opposite sides of the vane are cooled convectively with the air exiting from the channels 42 through exit apertures 44 along the pressure side of the vane.

With the trailing edge cooling configuration as described, it will be appreciated that the post-impingement cooling air flows in the channels 30 between the ribs 32 whereby the opposite sides of the airfoil 16 are convectively cooled. The cooling air exiting from between the ribs 32 flows into the plenum 34. The plenum feeds the row of film cooling holes 38 on the pressure side for film cooling of the pressure side of the airfoil. Thus, with the channels 30 providing relatively low pressure drop, sufficient air pressure is maintained within the plenum to drive the cooling air through the film cooling holes 38. The remaining portion of the cooling air flows about the pins 36 for pin cooling of the opposite sides of the airfoil. The pins cool the opposite sides of the airfoil in the region with the relatively higher external heat load than the external heat load in the area of the upstream convective channels 30. While the arrangement of the pins provide a significant pressure drop, this pressure drop can be tolerated since the coolant air flow is then discharged through trailing edge slots where the pressures are much lower. The flow of cooling air in channels 42 between ribs 40 also convectively cools the opposite sides of the vane directly adjacent the trailing edge 25. In the foregoing manner, the trailing edge cooling configuration hereof satisfies the cooling requirements of an advanced three-dimensional aerodynamic nozzle vane having significant bow and twist where impingement cooling is not practical in light of the axial extent of the trailing edge region of the airfoil.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An air-cooled nozzle for disposition in the hot gas path of a turbine comprising:

inner and outer platforms with an airfoil extending therebetween, said airfoil having opposite pressure and suction sides and an air-cooled trailing edge region having a trailing edge;

a plurality of ribs in said trailing edge region extending between said opposite sides and spaced one from the other in a generally radial direction between said platforms defining a plurality of generally axially extending radially spaced flow channels for directing cooling air generally axially toward said trailing edge;

a plurality of pins extending between said opposite sides of said airfoil at locations spaced axially downstream from said ribs and spaced radially from one another for impingement by the cooling air exiting the channels; and a plenum located generally axially between said ribs and said pins, and a plurality of film cooling holes in the pressure side of said airfoil in communication with said plenum, whereby cooling air is enabled for flow through said holes and internally within the trailing edge region about said pins.

2. A nozzle according to claim 1 wherein said pins are spaced from one another in a generally radial direction in at least two axially spaced rows thereof.

3. A nozzle according to claim 2 wherein said pins in a first row thereof upstream of a second downstream row of pins have cross-sectional areas greater than the cross-sectional areas of said second row of pins downstream of said upstream row of pins.

4. A nozzle according to claim 3 including a third row of pins spaced axially downstream from said second row of pins.

5. A nozzle according to claim 4 wherein each pin of said third row of pins has a cross-sectional area less than the cross-sectional area of each of the pins of said second row of pins.

6. A nozzle according to claim 5 wherein said pins are cylindrical in shape.

7. A nozzle according to claim 4 wherein the flowpath of the cooling air between the pins of the first row thereof is intercepted by pins of the second row thereof.

8. A nozzle according to claim 1 including a second set of ribs in said trailing edge region extending between said opposite sides of said airfoil, defining a plurality of second axially extending radially spaced channels at a location downstream of said pins.

9. A nozzle according to claim 8 wherein said second set of ribs are more closely radially spaced relative to one another than the radial spacing of the ribs of the first set thereof, whereby the second flow channels have a smaller cross-sectional area in the axial direction than the axial extent of the flow channels of the first set thereof.

10. An air-cooled nozzle for disposition in the hot gas path of a turbine comprising:

inner and outer platforms with an airfoil extending therebetween, said airfoil having opposite pressure and suction sides and an air-cooled trailing edge region having a trailing edge;

a plurality of ribs in said trailing edge region extending between said opposite sides and spaced one from the other in a generally radial direction between said platforms defining a plurality of generally axially extending radially spaced flow channels for directing cooling air generally axially toward said trailing edge;

a plurality of pins extending between said opposite sides of said airfoil at locations spaced axially downstream from said ribs and spaced radially from one another for impingement by the cooling air exiting the channels;

a plenum located generally axially between said ribs and said pins, and a plurality of film cooling holes in the pressure side of said airfoil in communication with said plenum, whereby cooling air is enabled for flow through said holes and internally within the trailing edge region about said pins; and exit apertures adjacent the trailing edge spaced radially from one another opening through said pressure side for flowing air received from about the pins to cool the trailing edge and for discharge into the hot gas path of the turbine.

11. A nozzle according to claim 10 wherein said exit apertures open solely through the pressure side of said airfoil.

12. A nozzle according to claim 1 wherein said pins are spaced from one another in a generally radial direction in at least two axially spaced rows thereof.

13. A nozzle according to claim 12 wherein said pins in a first row thereof upstream of a second downstream row of pins have cross-sectional areas greater than the cross-sectional areas of said second row of pins downstream of said upstream row of pins.

14. A nozzle according to claim 13 including a third row of pins axially spaced between said second row of pins and said exit apertures.

15. A nozzle according to claim 14 wherein each pin of said third row of pins has a cross-sectional area less than the cross-sectional area of each of the pins of said second row of pins.

16. A nozzle according to claim 15 wherein said pins are cylindrical in shape.

17. A nozzle according to claim 14 wherein the flowpath of the cooling air between the pins of the first row thereof is intercepted by pins of the second row thereof.

18. A nozzle according to claim 10 including a second set of ribs in said trailing edge region extending between said opposite sides of said airfoil, defining a plurality of second axially extending radially spaced channels at a location between said exit apertures and said pins.

19. A nozzle according to claim 18 wherein said second set of ribs are more closely radially spaced relative to one another than the radial spacing of the ribs of the first set thereof, whereby the second flow channels have a smaller cross-sectional area in the axial direction than the axial extent of the flow channels of the first set thereof.

* * * * *

UNITED STATES PATENT AND TRADEMARK OFFICE

CERTIFICATE OF CORRECTION

PATENT NO. : 7,121,787 B2
APPLICATION NO. : 10/834055
DATED : October 17, 2006
INVENTOR(S) : Jacks et al.

It is certified that error appears in the above-identified patent and that said Letters Patent is hereby corrected as shown below:

In the Claims:
Col. 6, Line 15
Claim 12, line 1, delete "claim 1" and insert --claim 10--.

Signed and Sealed this

Nineteenth Day of December, 2006

JON W. DUDAS
*Director of the United States Patent and Trademark Office*